US007184952B2

(12) United States Patent
Hillis et al.

(10) Patent No.: US 7,184,952 B2
(45) Date of Patent: Feb. 27, 2007

(54) METHOD AND SYSTEM FOR MASKING SPEECH

(75) Inventors: W. Daniel Hillis, Encino, CA (US); Bran Ferren, Beverly Hills, CA (US); Russel Howe, Montrose, CA (US)

(73) Assignee: Applied Minds, Inc., Glendale, CA (US)

( * ) Notice: Subject to any disclaimer, the term of this patent is extended or adjusted under 35 U.S.C. 154(b) by 0 days.

(21) Appl. No.: 11/457,100

(22) Filed: Jul. 12, 2006

(65) Prior Publication Data

US 2006/0247924 A1 Nov. 2, 2006

Related U.S. Application Data

(62) Division of application No. 10/205,328, filed on Jul. 24, 2002.

(51) Int. Cl.
*G10L 11/02* (2006.01)
*G10L 21/00* (2006.01)
*H04K 1/06* (2006.01)

(52) U.S. Cl. ..... 704/213; 704/278; 380/275

(58) Field of Classification Search ..... 704/203, 704/211, 213, 226, 227, 233, 270, 278; 380/35, 380/36, 275, 276; 381/73.1
See application file for complete search history.

(56) References Cited

U.S. PATENT DOCUMENTS

| | | | | |
|---|---|---|---|---|
| 3,718,765 A | | 2/1973 | Halaby | 179/1.5 M |
| 3,879,578 A | | 4/1975 | Wildi | |
| 3,985,957 A | | 10/1976 | Torn | 179/1.5 |
| 4,052,564 A | | 10/1977 | Propst et al. | 179/1.5 |
| 4,068,094 A | | 1/1978 | Schmid et al. | 179/1.5 |
| 4,099,027 A | | 7/1978 | Whitten | 179/1.5 |
| 4,195,202 A | | 3/1980 | McCalmont | 179/1.5 |
| 4,232,194 A | | 11/1980 | Adams | 179/1.5 R |
| 4,280,019 A | | 7/1981 | Propst et al. | 179/1.5 |
| 4,319,088 A | | 3/1982 | Orfield | 179/1.5 |
| 4,443,660 A | * | 4/1984 | DeLong | 380/36 |
| 4,706,282 A | * | 11/1987 | Knowd | 713/168 |
| 4,756,572 A | | 7/1988 | Dykstra | 381/73 |
| 4,802,219 A | | 1/1989 | Tjerlund | 380/39 |

(Continued)

FOREIGN PATENT DOCUMENTS

| | | |
|---|---|---|
| EP | 0 938 227 | 8/1999 |

(Continued)

*Primary Examiner*—Martin Lerner
(74) *Attorney, Agent, or Firm*—Michael A. Glenn; Glenn Patent Group

(57) ABSTRACT

A simple and efficient method for producing an obfuscated speech signal which may be used to mask a stream of speech, is disclosed. A speech signal representing the speech stream to be masked is obtained. The speech signal is then temporally partitioned into segments, preferably corresponding to phonemes within the speech stream. The segments are then stored in a memory, and some or all of the segments are subsequently selected, retrieved, and assembled into an obfuscated speech signal representing an unintelligible speech stream that, when combined with the speech signal or reproduced and combined with the speech stream, provides a masking effect. While the presently preferred embodiment finds application most readily in an open plan office, embodiments suitable for use in restaurants, classrooms, and in telecommunications systems are also disclosed.

14 Claims, 4 Drawing Sheets

U.S. PATENT DOCUMENTS

| | | | | |
|---|---|---|---|---|
| 4,852,170 | A | 7/1989 | Bordeaux | 381/41 |
| 4,905,278 | A | 2/1990 | Parker | 380/7 |
| 4,937,867 | A | 6/1990 | Kasparian et al. | |
| 5,105,377 | A | 4/1992 | Ziegler, Jr. | 364/724.01 |
| 5,315,661 | A | 5/1994 | Gossman et al. | 381/71 |
| 5,327,521 | A | 7/1994 | Savic et al. | 395/2.81 |
| 5,355,418 | A | 10/1994 | Kelsey et al. | 381/72 |
| 6,109,923 | A | 8/2000 | Rothenberg | 434/185 |
| 7,003,452 | B1 * | 2/2006 | Lubiarz et al. | 704/210 |
| 2002/0103636 | A1 * | 8/2002 | Tucker et al. | 704/205 |

FOREIGN PATENT DOCUMENTS

| | | |
|---|---|---|
| JP | 07 057 115 | 3/1995 |

* cited by examiner

METHOD AND SYSTEM FOR MASKING SPEECH

CROSS-REFERENCE TO RELATED APPLICATIONS

This application is a divisional of U.S. Ser. No. 10/205,328 filed Jul. 24, 2002.

BACKGROUND

1. Technical Field

This invention relates to systems for concealing information and, in particular, those systems that render a speech stream unintelligible.

2. Description of the Prior Art

The human auditory system is very adept at distinguishing and comprehending a stream of speech amid background noise. This ability offers tremendous advantages in most instances because it allows for speech to be understood amid noisy environments.

In many instances, though, such as in open plan office spaces, it is highly desirable to mask speech, either to provide privacy to the speaker or to lessen the distraction of those within audible range. In these cases, the human ability to discern speech in the presence of background noise presents special challenges. Simply introducing noise of a stochastic nature, e.g. white or pink noise, is typically unsuccessful, in that the amplitude of the introduced noise must be increased to unacceptable levels before the underlying speech can no longer be understood.

Accordingly, many prior art approaches to masking speech have focused on generating specialized forms of masking noise, in an effort to lower the intensity of noise required to render a stream of speech unintelligible. For example, U.S. Pat. No. 3,985,957 to Torn discloses a "sound masking system" for "masking conversation in an open plan office." In this approach, "a conventional generator of electrical random noise currents feeds its output through adjustable electric filter means to speaker clusters in a plenum above the office space." Despite such sophistication, in many instances the level of background noise required to mask conversation effectively remains unacceptably high.

Other approaches have sought to provide masking more discretely by deploying microphones and speakers in more complex physical configurations and controlling them with active noise cancellation algorithms. For example, U.S. Pat. No. 5,315,661 to Gossman describes a system for "controlling sound transmission through (from) a panel using sensors, actuators and an active control system. The method uses active structural acoustic control to control sound transmission through a number of smaller panel cells which are in turn combined to create a larger panel." It is intended that the invention serve as "a replacement for thick and heavy passive sound isolation material, or anechoic material." While such systems are in theory effective, they are difficult to implement in practice, and are often prohibitively expensive.

Several techniques for performing obfuscation (often termed scrambling) may also be found in the prior art. U.S. Pat. No. 4,068,094 to Schmid et al. describes "a method of scrambling and unscrambling speech transmissions by first dividing the speech frequencies into two frequency bands and reversing their order by modulating the speech information."

Adopting a somewhat different approach, U.S. Pat. No. 4,099,027 to Whitten discloses a system operating primarily in the time domain. Specifically, "a speech scrambler for rendering unintelligible a communications signal for transmission over nonsecure communications channels includes a time delay modulator and a coding signal generator in a scrambling portion of the system and a similar time delay modulator and a coding generator for generating an inverse signal in the unscrambling portion of the system."

These methods are effective in producing an obfuscated stream of speech, that when presented in place of the original stream of speech, is unintelligible. However, they are less effective in rendering a stream of speech unintelligible via superposition of the obfuscated stream of speech. This represents a significant deficiency for application to conversation masking in an office environment, where direct substitution of the obfuscated speech stream for the original speech stream is impractical if not impossible. Furthermore, due to the nature of the scrambling, the obfuscated speech stream does not sound speech-like to the listener. In environments such as open plan offices, the obfuscated stream may therefore prove more distracting than the original speech stream.

U.S. Pat. No. 4,195,202 to McCalmont suggests an improvement on these systems that may in fact produce a less intelligible composite stream, but does not address the need for a speech-like scrambled signal. In fact, a specific effort is made to eliminate one of the key features of human speech. An "encoding apparatus first divides a voice signal to be transmitted into two or more frequency bands. One or more of the frequency bands is frequency inverted, delayed in time relative to the other frequency bands and then recombined with the other frequency bands to produce a composite signal for transmission to a remote receiver. By selecting the magnitude of the delay to approximate the time constants of the cadence, or intersyllabic and phoneme generation rates, of the speech to which the voice signal corresponds, the amplitude fluctuations of the composite signal are substantially lessened and the cadence content of the signal is effectively disguised."

What is needed is a simple and effective system for masking a stream of speech in environments such as open plan offices, where an obfuscated speech stream cannot be substituted for, but merely added to, an original stream of speech. The method should provide an obfuscated speech stream that is speech-like in nature yet highly unintelligible. Furthermore, combination of the original speech stream and obfuscated speech stream should produce a combined speech stream that is also speech-like yet unintelligible.

SUMMARY OF THE INVENTION

The invention provides a simple and efficient method for producing an obfuscated speech signal which may be used to mask a stream of speech. A speech signal representing the speech stream to be masked is obtained. The speech signal is then temporally partitioned into segments, preferably corresponding to phonemes within the speech stream. The segments are then stored in a memory, and some or all of the segments are subsequently selected, retrieved, and assembled into an obfuscated speech signal representing an unintelligible speech stream that, when combined with the speech signal or reproduced and combined with the speech stream, provides a masking effect.

The obfuscated speech signal may be produced in substantially real time, allowing for direct masking of a speech stream, or may be produced from a recorded speech signal. In creating the obfuscated speech signal, segments within the speech signal may be reordered in a one-to-one fashion, segments may be selected and retrieved at random from a recent history of segments within the speech signal, or segments may be classified or identified and then selected with a relative frequency commensurate with their frequency of occurrence within the speech signal. Finally, it is possible that more than one selection, retrieval, and assembly process may be conducted concurrently to produce more than one obfuscated speech signal.

While the presently preferred embodiment of the invention most readily finds application in an open plan office, alternative embodiments may find application, for example, in restaurants, classrooms, and in telecommunications systems.

DESCRIPTION OF THE INVENTION

The invention provides a simple and efficient method for producing an obfuscated speech signal which may be used to mask a stream of speech.

Figure 1:
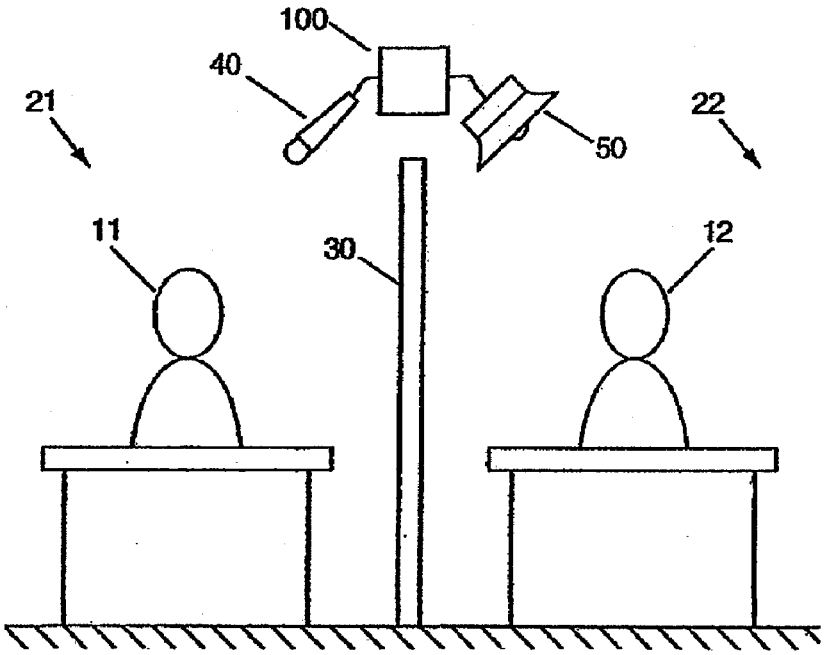
FIG. 1 shows a device for masking a speech stream in an open plan office according to the presently preferred embodiment of the invention.

FIG. 1 shows a device for masking a speech stream in an open plan office according to the presently preferred embodiment of the invention. A speaking office worker 11 in a first cubicle 21 wishes to hold a private conversation. The partition 30 separating the speaking worker's cubicle from an adjacent cubicle 22 does not provide sufficient acoustic isolation to prevent a listening office worker 12 in the adjacent cubicle from overhearing the conversation. This situation is undesirable because the speaking worker is denied privacy and the listening worker is distracted, or worse, may overhear a confidential conversation.

FIG. 1 illustrates how the presently preferred embodiment of the invention may be used to remedy this situation. A microphone 40 is placed in a position allowing acquisition of the stream of speech emanating from the speaking worker 11. Preferably, the microphone is mounted in a location where a minimum of acoustic information other than the desired speech stream is captured. A location substantially above the speaking worker 11, but still within the first cubicle 21, may provide satisfactory results.

The signal representing the stream of speech obtained by the microphone is provided to a processor 100 that identifies the phonemes composing the speech stream. In real time or near real time, an obfuscated speech signal is generated from a sequence of phonemes similar to the identified phonemes. When reproduced as an obfuscated speech stream, the obfuscated speech signal is speech-like, yet unintelligible.

The obfuscated speech stream is reproduced and presented, using one or more speakers 50, to those workers who may potentially overhear the speaking worker, including the listening worker 12 in the adjacent cubicle 22. The obfuscated speech stream, when heard superimposed upon the original speech stream, yields a composite speech stream that is unintelligible, thus masking the original speech stream. Preferably, the obfuscated speech stream is presented at an intensity comparable to that of the original speech stream. Presumably, the listening worker is well accustomed to hearing speech-like sounds emanating from the first cubicle at an intensity commensurate with typical human speech. The listening worker is therefore unlikely to be distracted by the composite speech stream provided by the invention.

The speakers 50 are preferably placed in a location where they are audible to the listening worker but not audible to the speaking worker. Additionally, care must be taken to ensure that the listening worker cannot isolate the original speech stream from the obfuscated speech stream using directional cues. Multiple speakers, preferably placed so as not to be coplanar with one another, may be used to create a complex sound field that more effectively masks the original speech stream emanating from the speaking worker. Additionally, the system may use information about the location of the speaker, e.g. based upon the location of the microphone, and activate/deactivate various speakers to achieve an optimum dispersion of masking speech. In this regard, an open office environment may be monitored to control speakers and to mix various obfuscated conversations derived from multiple locations so that several conversations may take place, and be masked, simultaneously. For example, the system can direct and weight signals to various speakers based upon information derived from several microphones.

Figure 2:
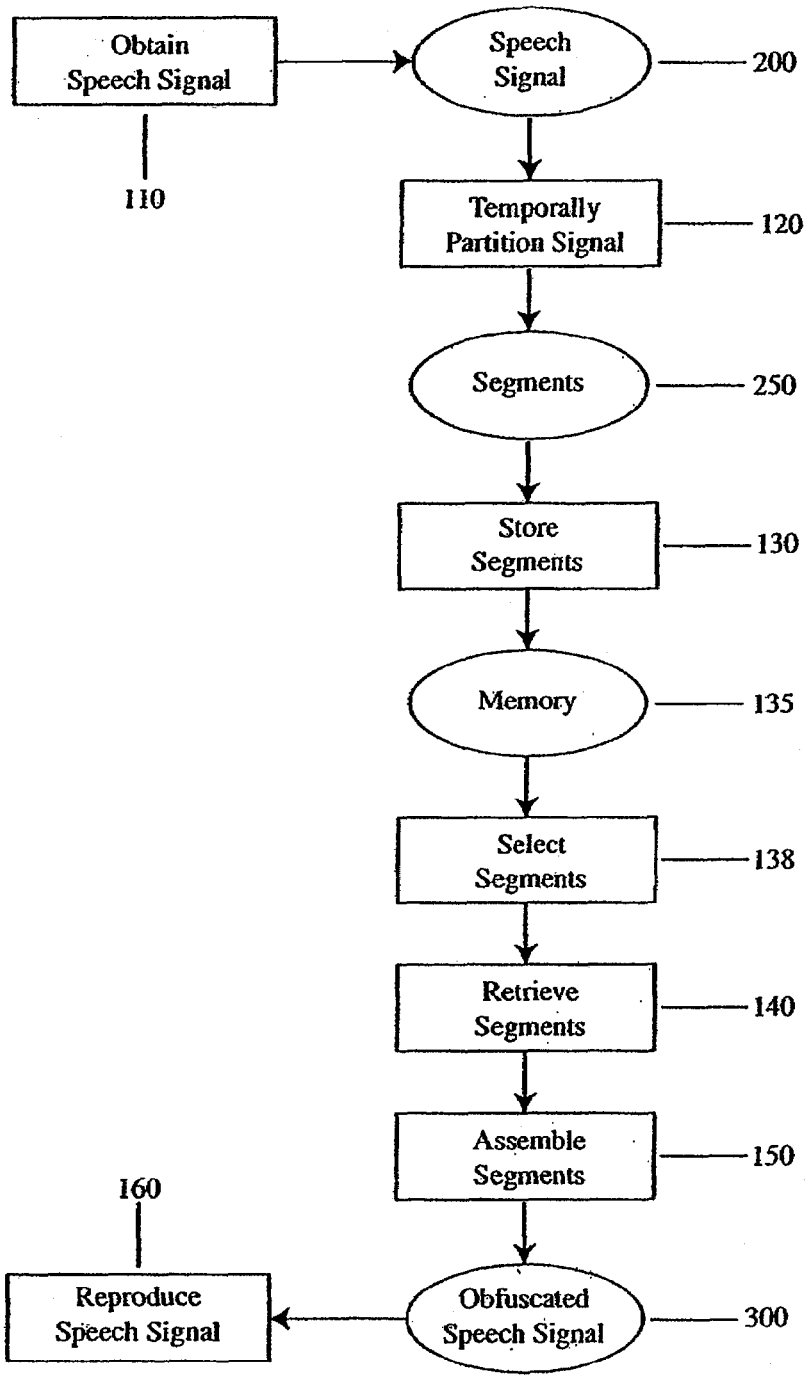
FIG. 2 is a flow chart showing a method for producing an obfuscated speech signal according to the presently preferred embodiment of the invention.

FIG. 2 is a flow chart showing a method for producing an obfuscated speech signal according to the presently preferred embodiment of the invention. In the preferred embodiment, this process is conducted by the processor 100 of FIG. 1. A speech signal 200 representing the speech stream to be masked is obtained 110 from a microphone or similar source, as shown in FIG. 1. The speech signal s(t), is preferably obtained and subsequently manipulated as a discrete series of digital values, s(n). In the preferred embodiment, where the microphone 40 provides an analog signal, this requires that the signal be digitized by an analog-to-digital converter.

Once obtained, the speech signal is temporally partitioned 120 into segments 250. As described above, the segments correspond to phonemes within the speech stream. The segments are then stored 130 in a memory 135, thus allowing selected segments to be subsequently selected 138, retrieved 140, and assembled 150. The result of the assembly operation is an obfuscated speech signal 300 representing an obfuscated speech stream.

The obfuscated speech signal may then be reproduced 160, preferably through one or more speakers as shown in FIG. 1. In the preferred embodiment, where the one or more speakers require an analog input signal, this may require the use of a digital-to-analog converter. Alternatively, the speech signal and obfuscated speech signal may be combined, and the combined signal reproduced.

It is important to note that while the flow of data through the above process is as shown in FIG. 2, the operations detailed may in practice be executed concurrently, providing substantially steady state processing of data in real time. Alternatively, the process may be conducted as a post-processing operation applied to a pre-recorded speech signal.

Selection 138, retrieval 140, and assembly 150 of the signal segments may be accomplished in any of several manners. In particular, segments within the speech signal may be reordered in a one-to-one fashion, segments may be selected and retrieved at random from a recent history of segments within the speech signal, or segments may be classified or identified and then selected with a relative frequency commensurate with their frequency of occurrence within the speech signal. Furthermore, it is possible that several selection, retrieval, and assembly processes may be conducted concurrently to produce several obfuscated speech signals.

Figure 3:
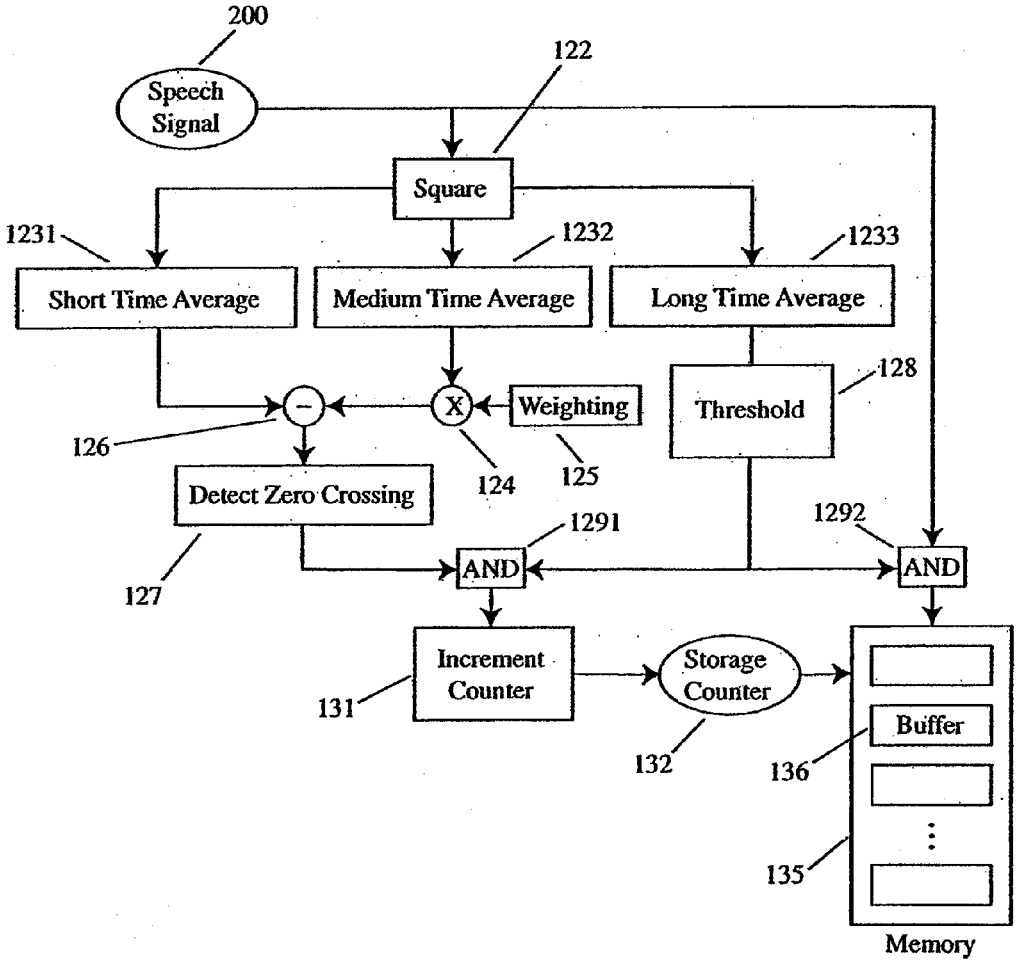
FIG. 3 is a detailed flow chart showing a method for temporally partitioning a speech signal into segments and storing the segments according to the presently preferred embodiment of the invention.

FIG. 3 is a detailed flow chart showing a method for temporally partitioning a speech signal into segments and storing the segments according to the presently preferred embodiment of the invention. Here, the steps of temporally partitioning the signal into segments and storing the segments in memory shown in FIG. 2 are described in greater detail. The partitioning operation is conducted in a manner such that the resulting segments correspond to phonemes within the speech stream.

To partition the speech signal 200 into segments, the speech signal is squared 122, and the resulting signal $s^2(n)$ is averaged 1231, 1232, 1233 over three time scales, i.e. a short time scale $T_s$; a medium time scale $T_m$; and a long time scale $T_l$. The averaging is preferably implemented through the calculation of running estimates of the averages, $V_i$, according to the expression $$V_i(n+1)=a_i s(n)=(1-a)V_i(n),\ i\in[l,m,s]. \tag{1}$$

This is approximately equivalent to a sliding window average of $N_i$ samples, with $$a_l = \frac{1}{N_l} = \frac{1}{fT_i} \tag{2}$$

where f is the sampling rate and $T_i$ the time scale.

Preferably, the short time scale $T_s$ is selected to be characteristic of the duration of a typical phoneme and the medium time scale $T_m$ is selected to be characteristic of the duration of a typical word. The long time scale $T_l$ is a conversational time scale, characteristic of the ebb and flow of the speech stream as a whole. In the presently preferred embodiment of the invention, values of 0.125, 0.250, and 1.00 sec, respectively, have provided acceptable system performance, although those skilled in the art will appreciate that this embodiment of the invention may readily be practiced with other time scale values.

The result of the medium time scale average 1232 is multiplied 124 by a weighting 125, and then subtracted 126 from the result of the short time scale average 1231. Preferably, the value of the weighting is between 0 and 1, In practice, a value of ½ has proven acceptable.

The resulting signal is monitored to detect 127 zero crossings. When a zero crossing is detected, a true value is returned. A zero crossing reflects a sudden increase or decrease in the short time scale average of the speech signal energy that could not be tracked by the medium time scale average. Zero crossings thus indicate energy boundaries that generally correspond to phoneme boundaries, providing an indication of the times at which transitions occur between successive phonemes, between a phoneme and a subsequent period of relative silence, or between a period of relative silence and a subsequent phoneme.

The result of the long time average 1233 is passed to a threshold operator 128. The threshold operator returns "true" if the long time average is above an upper threshold value and "false" if the long time average is below a lower threshold value. In some embodiments of the invention, the upper and lower threshold values may be the same. In the preferred embodiment, the threshold operator is hysteretic in nature, with differing upper and lower threshold values.

If a speech signal 200 is present and 1292 the threshold operator 128 returns a true value, the speech signal is stored in a buffer 136 within an array of buffers residing in the memory 135. The particular buffer in which the signal is stored is determined by a storage counter 132.

If a zero crossing is detected 127 and 1291 the threshold operator 128 returns a "true" value, the storage counter 132 is incremented 131, and storage begins in the next buffer 136 within the array of buffers in the memory 135. In this manner, each buffer in the array of buffers is filled with a phoneme or interstitial silence of the speech signal, as partitioned by the detected zero crossings. When the last buffer in the array of buffers is reached, the counter is reset and the contents of the first buffer are replaced with the next phoneme or interstitial silence. Thus, the buffer accumulates and then maintains a recent history of the segments present within the speech signal.

It should be noted that this method represents only one of a variety of ways in which the speech signal may be partitioned into segments corresponding to phonemes. Other algorithms, including those used in continuous speech recognition software packages, may also be employed.

Figure 4:
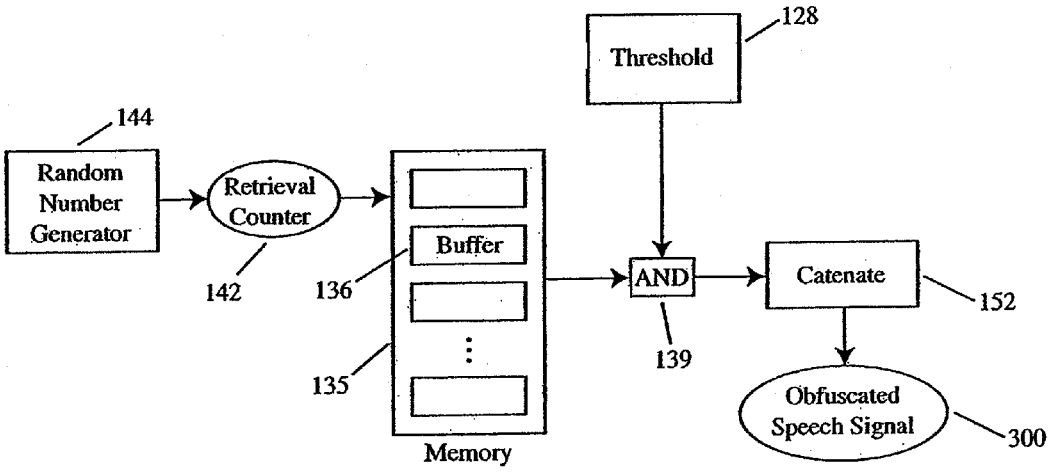
FIG. 4 is a detailed flow chart showing a method for selecting, retrieving, and assembling segments according to the presently preferred embodiment of the invention.

FIG. 4 is a detailed flow chart showing a method for selecting, retrieving, and assembling segments according to the presently preferred embodiment of the invention. Here, the steps of selecting 138 segments, retrieving 140 segments from memory and assembling 150 segments into an obfuscated speech signal shown in FIG. 2 are presented in greater detail.

A random number generator 144 is used to determine the value of a retrieval counter 142. The buffer 136 indicated by the value of the counter is read from the memory 135. When the end of the buffer is reached, the random number generator provides another value to the retrieval counter, and another buffer is read from memory. The contents of the buffer are appended to the contents of the previously read buffer through a catenation 152 operation to compose the obfuscated speech signal 300. In this manner, a random sequence of signal segments reflecting the recent history of segments within the speech signal 200 are combined to form the obfuscated speech signal 300.

It is often desirable to provide masking only during moments of active conversation. Thus, in the preferred embodiment, buffers are only read from memory if a buffer is available and 139 the threshold operator 128 of FIG. 3 returns a "true" value.

Several other noteworthy features have also been incorporated into the presently preferred embodiment of the invention. First, a minimum segment length is enforced. If a zero crossing indicates a phoneme or interstitial silence less than the minimum segment length, the zero crossing is ignored and storage continues in the current buffer 136 within the array of buffers in the memory 135. Also, a maximum phoneme length is enforced, as determined by the size of each buffer in the buffer array. If, during storage, the maximum phoneme length is exceeded, a zero crossing is inferred, and storage begins in the next buffer within the array of buffers. To avoid conflict between storage in and retrieval from the array of buffers, if a particular buffer is currently being read and is simultaneously selected by the storage counter 132, the storage counter is again incremented, and storage begins in the next buffer within the array of buffers.

Finally, during the catenation 152 operation, it may be advantageous to apply a shaping function to the head and tail of the segment selected by the retrieval counter 142. The shaping function provides a smoother transition between successive segments in the obfuscated speech signal, thereby yielding a more natural sounding speech stream upon reproduction 160. In the preferred embodiment, each segment is smoothly ramped up at the head of the segment and down at the tail of the segment using a trigonometric function. The ramping is conducted over a time scale shorter than the minimum allowable segment. This smoothing serves to eliminate audible pops, clicks, and ticks at the transitions between successive segments in the obfuscated speech signal.

The masking method described herein may be used in environments other than office spaces. In general, it may be employed anywhere a private conversation may be overheard. Such spaces include, for example, crowded living quarters, public phone booths, and restaurants. The method may also be used in situations where an intelligible stream of speech may be distracting. For example, in open space classrooms, students in one partitioned area may be less distracted by an unintelligible voice-like speech stream emanating from an adjacent area than by a coherent speech stream.

The invention is also easily extended to the emulation of realistic yet unintelligible voice-like background noise. In this application, the modified signal may be generated from a previously obtained voice recording, and presented in an otherwise quiet environment. The resulting sound presents the illusion that one or more conversations are being conducted nearby. This application would be useful, for example, in a restaurant, where an owner may want to promote the illusion that a relatively empty restaurant is populated by a large number of diners, or in a theatrical production to give the impression of a crowd.

If the specific masking method employed is known to both of two communicating parties, it may be possible to transmit an audio signal secretively using the described technique. In this case, the speech signal would be masked by superposition of the obfuscated speech signal, and unmasked upon reception. It is also possible that the particular algorithm used is seeded by a key known only to the communicating parties, thereby thwarting any attempts by a third party to intercept and unmask the transmission.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

The invention claimed is:

1. A method of producing a substantially unintelligible, obfuscated speech signal from intelligible speech, comprising the steps of:

obtaining a speech signal representing a speech stream;

temporally partitioning said speech signal into a plurality of segments, said segments occurring in an initial order within said speech signal;

selecting a plurality of selected segments from among said segments; and assembling said selected segments, in an order different than said initial order, to produce said obfuscated speech signal;

wherein said segments represent phonemes within said speech stream;

wherein said temporally partitioning step comprises the steps of:

squaring said speech signal;

calculating a short time average of said speech signal over a short time scale;

calculating a medium time average of said speech signal over a medium time scale;

calculating a difference between said short time average and said medium time average; and detecting zero crossings in said difference;

wherein said zero crossings delineate said segments.

2. The method of claim 1, wherein said short time scale characterizes a length of a typical phoneme in said speech stream.

3. The method of claim 1, wherein said medium time scale characterizes a length of a typical word in said speech stream.

4. A method of producing a substantially unintelligible, obfuscated speech signal from intelligible speech, comprising the steps of:

obtaining a speech signal representing a speech stream;

temporally partitioning said speech signal into a plurality of segments, said segments occurring in an initial order within said speech signal;

selecting a plurality of selected segments from among said segments; and assembling said selected segments, in an order different than said initial order, to produce said obfuscated speech signal;

further comprising the step, immediately following said temporally partitioning step, of:

storing said segments in a memory; and further comprising the step, immediately following said selecting step, of:

retrieving said selected segments from said memory;

wherein said storing step comprises the steps of:

squaring said speech signal;

calculating a long time average of said speech signal over a long time scale;

determining when said long time average is above a first threshold and when said long time average is below a second threshold;

halting said storing of said segments in said memory when said long time average is below said second threshold; and resuming said storing of said segments in said memory when said long time average is above said first threshold.

5. The method of claim 4, wherein said long time scale characterizes a conversational time scale of said speech stream.

6. A method of producing a substantially unintelligible, obfuscated speech signal from intelligible speech, comprising the steps of:

obtaining a speech signal representing a speech stream;

temporally partitioning said speech signal into a plurality of segments, said segments occurring in an initial order within said speech signal;

selecting a plurality of selected segments from among said segments; and assembling said selected segments, in an order different than said initial order, to produce said obfuscated speech signal;

further comprising the step, immediately following said temporally partitioning step, of:

storing said segments in a memory; and further comprising the step, immediately following said selecting step, of:

retrieving said selected segments from said memory;

wherein said retrieving step comprises the steps of:

squaring said speech signal;

calculating a long time average of said speech signal over a long time scale;

determining when said long time average is above a first threshold and when said long time average is below a second threshold;

halting said retrieving of said segments from said memory when said long time average is below said second threshold; and resuming said retrieving of said segments from said memory when said long time average is above said first threshold.

7. The method of claim 6, wherein said long time scale characterizes a conversational time scale of said speech stream.

8. An apparatus for producing a substantially unintelligible, obfuscated speech signal from intelligible speech, comprising:

a module for obtaining a speech signal representing a speech stream;

a module for temporally partitioning said speech signal into a plurality of segments, said segments occurring in an initial order within said speech signal;

a module for selecting a plurality of selected segments from among said segments; and a module for assembling said selected segments, in an order different than said initial order, to produce said obfuscated speech signal;

wherein said module for temporally partitioning further comprises:

a module for squaring said speech signal;

a module for calculating a short time average of said speech signal over a short time scale;

a module for calculating a medium time average of said speech signal over a medium time scale;

a module for calculating a difference between said short time average and said medium time average; and a module for detecting zero crossings in said difference;

wherein said zero crossings delineate said segments.

9. The apparatus of claim 8, wherein said short time scale characterizes a length of a typical phoneme in said speech stream.

10. The apparatus of claim 8, wherein said medium time scale characterizes a length of a typical word in said speech stream.

11. An apparatus for producing a substantially unintelligible, obfuscated speech signal from intelligible speech, comprising:

a module for obtaining a speech signal representing a speech stream;

a module for temporally partitioning said speech signal into a plurality of segments, said segments occurring in an initial order within said speech signal;

a module for selecting a plurality of selected segments from among said segments;

a module for assembling said selected segments, in an order different than said initial order, to produce said obfuscated speech signal;

a memory for storing said segments; and a module for retrieving said selected segments from said memory;

wherein said memory comprises:

a module for squaring said speech signal;

a module for calculating a long time average of said speech signal over a long time scale;

a module for determining when said long time average is above a first threshold and when said long time average is below a second threshold;

a module for halting said storing of said segments in said memory when said long time average is below said second threshold; and a module for resuming said storing of said segments in said memory when said long time average is above said first threshold.

12. The apparatus of claim 11, wherein said long time scale characterizes a conversational time scale of said speech stream.

13. An apparatus for producing a substantially unintelligible, obfuscated speech signal from intelligible speech, comprising:

a module for obtaining a speech signal representing a speech stream;

a module for temporally partitioning said speech signal into a plurality of segments, said segments occurring in an initial order within said speech signal;

a module for selecting a plurality of selected segments from among said segments;

a module for assembling said selected segments, in an order different than said initial order, to produce said obfuscated speech signal;

a memory for storing said segments; and a module for retrieving said selected segments from said memory;

wherein said module for retrieving comprises:

a module for squaring said speech signal;

a module for calculating a long time average of said speech signal over a long time scale;

a module for determining when said long time average is above a first threshold and when said long time average is below a second threshold;

a module for halting said retrieving of said segments from said memory when said long time average is below said second threshold; and a module for resuming said retrieving of said segments from said memory when said long time average is above said first threshold.

14. The apparatus of claim 13, wherein said long time scale characterizes a conversational time scale of said speech stream.

* * * * *